US005355609A

United States Patent [19]

Schenke

[11] Patent Number: 5,355,609

[45] Date of Patent: Oct. 18, 1994

[54] LASER BEAM SIGHTING APPARATUS WITH A SELECTIVELY ADJUSTABLE BEAM WIDTH

[76] Inventor: Reynold A. Schenke, 290 Old Leacock Rd., Paradise, Pa. 17562

[21] Appl. No.: 118,288

[22] Filed: Sep. 9, 1993

Related U.S. Application Data

[63] Continuation of Ser. No. 985,939, Dec. 4, 1992, abandoned.

[51] Int. Cl.[5] ..... F41G 1/35; F41G 1/36

[52] U.S. Cl. ..... 42/103; 33/DIG. 21; 362/110

[58] Field of Search ..... 33/251, 241, DIG. 21; 42/103, 100; 362/110, 114, 183

[56] References Cited

U.S. PATENT DOCUMENTS

| | | | |
|---|---|---|---|
| 3,464,770 | 9/1969 | Schmidt | 356/4 |
| 3,656,845 | 4/1972 | Koch-Bossard et al. | 353/42 |
| 3,803,399 | 4/1974 | Smith et al. | 240/61 |
| 3,867,764 | 2/1975 | Dunmire et al. | 33/241 |
| 4,152,754 | 5/1979 | de Filippis et al. | 42/103 |
| 4,168,588 | 9/1979 | Snyder | 362/110 |
| 4,212,109 | 7/1980 | Snyder | 33/241 |
| 4,266,873 | 5/1981 | Hacskaylo et al. | 356/251 |
| 4,295,289 | 10/1981 | Snyder | 42/103 |
| 4,313,272 | 2/1982 | Matthews | 362/110 |
| 4,627,183 | 12/1986 | Stuckman | 42/1.01 |
| 4,707,595 | 11/1987 | Meyers | 250/333 |
| 4,738,044 | 4/1988 | Osterhout | 42/103 |
| 4,934,086 | 6/1990 | Houde-Walter | 42/103 |
| 4,939,863 | 7/1990 | Alexander et al. | 42/103 |
| 4,991,183 | 2/1991 | Meyers | 372/100 |
| 5,036,517 | 7/1991 | Meyers | 362/183 |
| 5,040,885 | 8/1991 | Simms | 350/537 |
| 5,042,048 | 8/1991 | Meyer | 362/109 |
| 5,052,801 | 10/1991 | Downes, Jr. et al. | 356/153 |
| 5,056,097 | 10/1991 | Meyers | 362/183 |
| 5,064,988 | 11/1991 | E'nama et al. | 42/103 |

*Primary Examiner*—David Brown

*Attorney, Agent, or Firm*—Jacobson, Price, Holman & Stern

[57] ABSTRACT

An apparatus for emitting a selectively adjustable laser beam for illuminating a target at various distances from the apparatus, whereby the width of the laser beam may be broadened or narrowed selectively, so as to maintain the diameter of the beam imprint at a constant on targets of various distances. A mechanism is provided for selectively sliding the laser source with respect to a lens system, to thereby achieve a particular distance between the laser source and the lens system, this particular distance determining the width of the laser beam. The apparatus is mounted directly to a weapon for sighting purposes, and further comprises a windage and elevation adjustment mechanism; a remote control system whereby the laser beam can be narrowed or broadened without having to directly access the main housing; and a drop compensation mechanism whereby projectile drop is compensated for automatically.

24 Claims, 3 Drawing Sheets

LASER BEAM SIGHTING APPARATUS WITH A SELECTIVELY ADJUSTABLE BEAM WIDTH

This is a continuation of application Ser. No. 07/985,939, filed Dec. 4, 1993, now abandoned.

BACKGROUND OF THE INVENTION

The present invention relates to an apparatus for emitting a selectively adjustable width bore sighted laser beam for illuminating a target at various distances from the apparatus, and in particular, where the width of the laser beam can be increased or decreased selectively.

Examples of prior patents which disclose aiming devices are U.S. Pat. No. 5,052,801 to Downes, Jr et al.; No. 5,040,885 to Simms; No. 4,939,863 to Alexander et al.; No. 4,627,183 to Stuckman; No. 4,266,873 to Hacskaylo et al.; No. 4,212,109 to Snyder; No. 3,867,764 to Dunmire et al.; No. 3,656,845 to Koch-Bossard et al.; No. 3,803,399 to Smith et al.; and No. 3,464,770 to Schmidt et al. The foregoing patents fail to provide, among other things, a laser beam having a selectively adjustable beam width.

SUMMARY OF THE INVENTION

Accordingly, it is a primary object of the present invention to provide an aiming apparatus for emitting a selectively adjustable laser beam for illuminating a target at various distances from the apparatus, wherein the emitted laser beam has a selectively adjustable width.

It is a further object of the present invention to provide an apparatus for emitting a selectively adjustable laser beam, which apparatus includes a windage and elevation adjustment mechanism.

It is another object of the present invention to provide a laser beam sighting apparatus capable of projecting a beam imprint of constant diameter on a target at near and far distances.

A still further object of the present invention is to provide an apparatus for emitting a selectively adjustable laser beam, which apparatus includes an automatic mechanism capable of compensating for projectile drop.

To achieve these and other objects, the apparatus of the present invention comprises a main housing having a proximal end and a distal end; a lens system at the distal end of the main housing for projecting a laser beam; a laser source slidably contained within the main housing, the laser source being slidable linearly through the main housing; and means for selectively sliding the laser source through the main housing to adjust the distance between the laser source and the lens system, this distance determining the width of the laser beam.

The apparatus of the present invention is mounted directly to a weapon, and further comprises a windage and elevation adjustment mechanism; a remote control system whereby the width of the laser beam can be adjusted without having to directly access the main housing; and a drop compensation mechanism whereby projectile drop is compensated for automatically.

Moreover, the sliding mechanism automatically adjusts the elevation of the beam to compensate for the path of flight of a bullet or other projectile. Specifically, the beam zoomed for close targets is projected slightly higher to compensate for the rise in the path of the bullet at close range (approximately 25 yards). However, when aiming at far targets (approximately 200 yards or more), the beam is projected slightly lower to compensate for the fall in the bullet path at far distances.

DESCRIPTION OF A PREFERRED EMBODIMENT

With reference to FIGS. 1–4, a preferred embodiment of the present invention will now be described.

Figure 1:
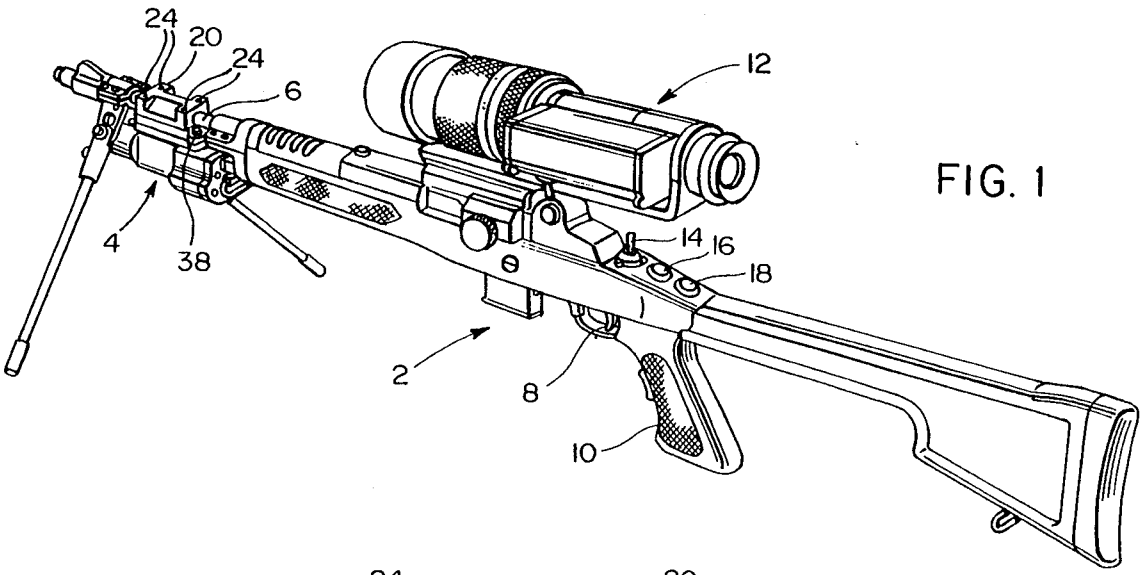
FIGS. 1 and 2 illustrate the laser unit attached to a weapon in accordance with the present invention.

In FIG. 1, a rifle 2 is shown having mounted a laser unit 4 on a barrel 6. The rifle further includes a trigger 8, a pistol grip 10, and an infrared viewer 12. Mounted above the trigger 8 and pistol grip 10, are a toggle switch 14 and two battery-retaining swivel caps 16 and 18. The switch 14 and swivel caps 16 and 18 are part of the laser unit 4 of the present invention.

Figure 2:
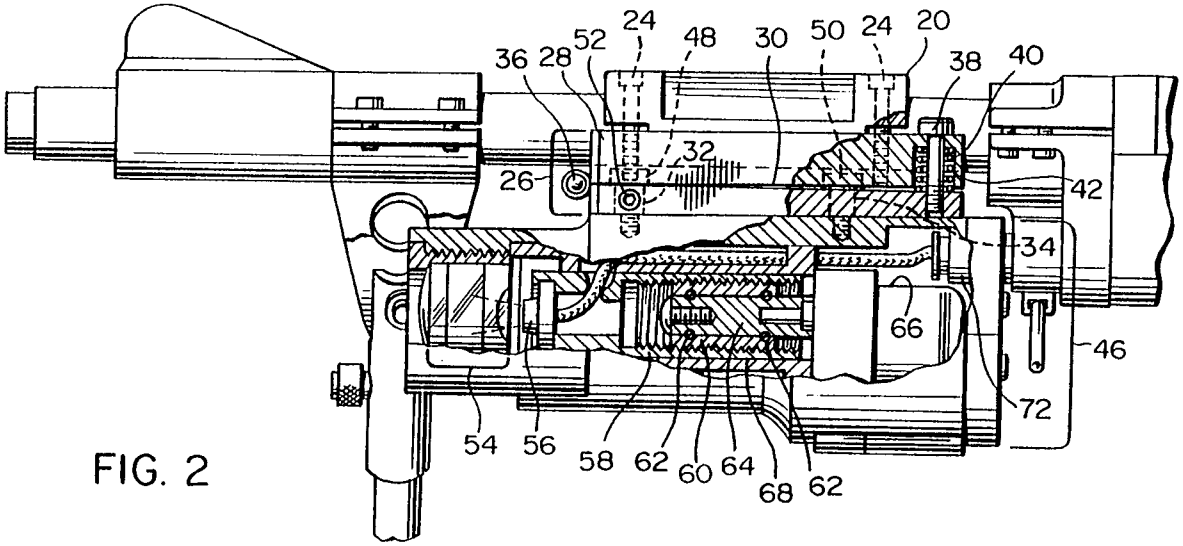
Figure 3:
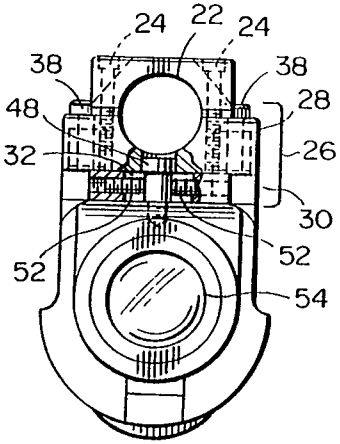
FIG. 3 is a frontal view of the laser unit illustrated in FIGS. 1 and 2.

With reference to FIGS. 2–3, the laser unit 4 is mounted on the barrel 6 using a generally U-shaped bracket 20. More specifically, the U-shaped bracket 20 mates with the laser unit 4 so as to define a cylindrical aperture 22 which receives the barrel 6. Four mounting bolts 24 are threadably received through the U-shaped bracket by laser unit 4 to thereby secure the laser unit 4 to the U-shaped bracket 20 and the barrel 6.

For elevation and windage adjustment, the laser unit 4 includes a double-plate elevation and windage adjustment mechanism 26. The adjustment mechanism 26 is defined, in part, by an upper plate 28 which receives the four mounting bolts 24 and a lower plate 30 which includes a slot 32 and a pivot aperture 34. The lower plate 30 of the adjustment mechanism 26 is hingedly mounted to the upper plate 28 by a hinge 36 and a pair of elevation adjustment bolts 38. Each of the elevation adjustment bolts 38 includes an intermediate unthreaded portion which passes through upper plate 28, and a distal threaded portion which passes through the upper plate 28 and threadably engages the lower plate 30. A spring 40 is disposed circumferentially around each elevation adjustment bolt 38 within the upper plate 28 and between the two plates 28 and 30. The spring 40, which is biased in a compressed state, applies a separating force which acts to separate the upper plate 28 from the lower plate 30. As FIG. 2 more clearly illustrates, the upper plate 28 can include a pair of cylindrical bores 42 wider than the diameter of the elevation adjustment bolts 38, which bores 42 are designed to receive and securely retain the springs 40.

The laser unit 4 further comprises a main body 46 which houses many of the electrical components of the laser unit 4 as well as the drive mechanism thereof. The main body 46 is attached to the bottom plate 30 of the adjustment mechanism 26 using a slide bolt 48 and a pivot bolt 50. The slide bolt 48 includes an intermediate unthreaded portion which passes through the slot 32 in the bottom plate 30, and a distal threaded portion which engages the main body 46. Likewise, the pivot bolt 50 includes an intermediate non-threaded portion which passes through the pivot aperture 34, and a distal threaded portion which engages the main body 46. In addition, there are two oppositely disposed windage adjustment bolts 52 disposed through the lateral sides of the bottom plate 30 and in alignment with the slot 32. The distal tip of each windage adjustment bolt 52 is disposed in the slot 32 so as to engage the non-threaded intermediate portion of the slide bolt 48. Each windage adjustment bolt 52 is long enough to contact the slide bolt 48 when the slide bolt is in its most distant position in the slot 32 from the lateral side in which the windage adjustment bolt 52 is disposed. Preferably, the head of each windage adjustment bolt 52 has an allen-wrench configuration and is received entirely within the lateral sides of the bottom plate so as to not protrude therefrom.

Housed within the main body 46, is a fixed lens system 54, an infrared laser 56, a drive tube 58, a nylon follower nut 60, a clutch assembly 62, a drive shaft 64, and a D.C. reversible gear motor 66. In particular, the drive tube 58 is slidably received within a smooth bore 68 of the main body 46. The drive tube 58 has a smooth exterior and a threaded interior, the interior threads of the drive tube 58 being designed to engage the follower nut 60. The follower nut 60 includes a threaded exterior and a generally smooth interior. The threaded exterior of the follower nut 60 engages the interior threads of the drive tube 58. The clutch assembly 62 comprises several 0-rings circumferentially surrounding the drive shaft 64. The generally smooth interior of the follower nut 60 includes several circumferential grooves, each for receiving and retaining one of the 0-rings which define the clutch assembly 62. As a result of the foregoing configuration, the drive shaft 64 frictionally engages the follower nut 60 by way of the clutch assembly 62. This frictional engagement, however, can be overcome by excessive rotational force to allow for relative rotation between the drive shaft 64 and the follower nut 60, whenever the drive tube 58 has reached either extreme of the bore 68. The D.C. electric motor 66 is connected to and rotates the drive shaft 64. The laser 56 is securely mounted to a distal end of the drive tube 58 for linear movement therewith along the inside of the main body 46.

The main body 46 also houses a six-conductor power cable 70 extending from the laser 56 back to a nine-pin connector 72 located at the rear of the main body 46. The nine-pin connector 72 supplies power from the stock of the rifle 2 (as will be described hereinafter) to the six-conductor power cable 70 and, through a separate set of conductors, to the D.C. electric motor 66. Several conductors extend internally or externally from the nine-pin connector 72 back to the pistol grip 10.

Figure 4:
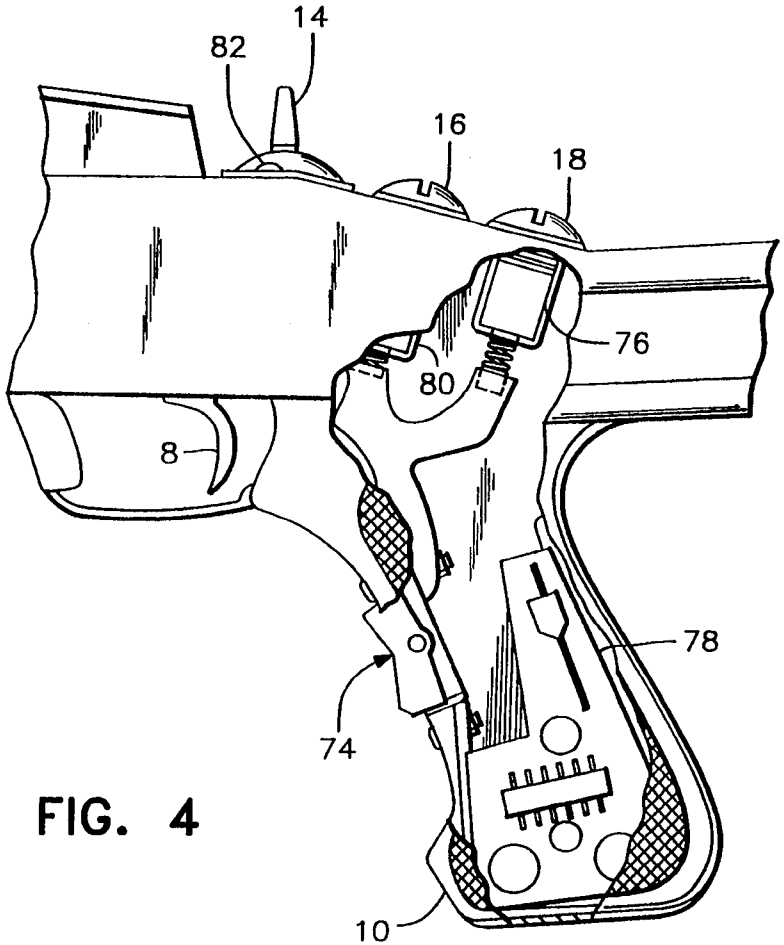
FIG. 4 illustrates a pistol grip with a rocker switch for selectively controlling the laser unit.

With reference to FIG. 4, the internal electrical components of the pistol grip 10 will now be described. Of the several conductors which extend through the weapon from the nine-pin connector 72, the ones which provide power to the D.C. electric motor 66 are electrically connected through a rocker switch 74 to a drive power supply 76. Specifically, the rocker switch 74 is wired such that pressing the rocker switch in one direction causes the D.C. motor 66 to rotate in a first direction, while pressing the rocker switch 74 in an opposite direction effects reverse rotation of the motor 66. The rocker switch 74 is mechanically biased so as to remain in a neutral position whereby no electrical connections effect rotation of the motor. Preferably, the drive power supply is a six volt battery; however, the voltage and type of power supply can vary and depend primarily on the electric motor's design, desired drive speed, and other similar factors.

The conductors which supply power to the laser 56, on the other hand, are electrically connected through a circuit board 78 to a laser power supply 80. The laser power supply 80 also preferably comprises a five volt battery, but is not limited thereto. The circuit board 78 includes conventional circuitry for controlling the laser 56.

The toggle switch 14 is connected in series between the rocker switch 74 and the drive power supply 76, and in series between the laser power supply 80 and circuit board 78. Accordingly, the toggle switch 14 acts as a main power switch capable of disrupting the flow of power from both power supplies. Preferably, the toggle switch 14 includes a visual indicator for indicating when power is ON, such as a pulsing light emitting diode (LED) 82 which flashes whenever power is ON.

Figure 5:
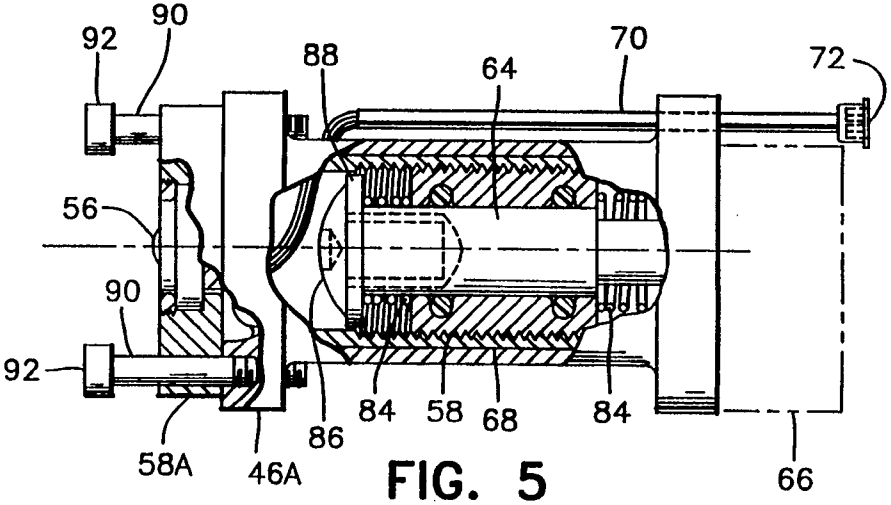
FIG. 5 illustrates the mechanism for adjusting the position of the laser source.

As FIG. 5 indicates, the laser unit 4 can also include a pair of oppositely disposed springs 84 bearing against the nylon follower nut 60, and a retaining bolt 86 threadably received longitudinally in the drive shaft 64. A conventional washer 88 is positioned between the head of the retaining bolt 86 and the drive shaft 64. In particular, the retaining bolt 86 is threaded into the opposite end of the drive shaft 64 from the motor 66. The washer 88 preferably has an outer diameter slightly less than the inner diameter of the drive tube 58. One of the springs 84 is positioned between the motor 66 and the follower nut 60, while the other spring 84 is positioned between the washer 88 and the follower nut 60.

In addition, a pair of guide bolts 90 are threadably received by a forward flange 46A of the main body 46. A front portion 58A of the drive tube 58 extends forward of the flange 46A and rides along a smooth surface of the guide bolts 90. The head of each guide bolt defines a guide stop 92.

Figure 6:
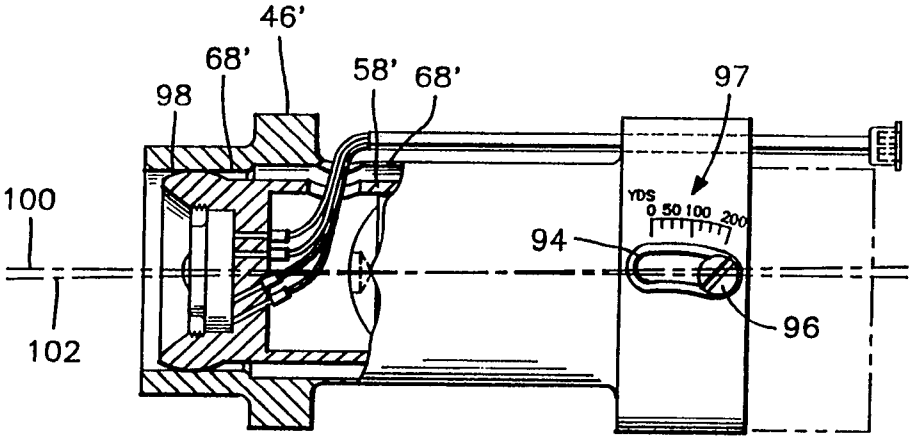
FIG. 6 illustrates the projectile drop compensating mechanism of the laser unit in accordance with the present invention.

Alternatively, as FIG. 6 illustrates, the laser unit 4 can include a custom main body 46' having a cam 94, and a cam follower 96 threadably received in the drive tube 58'. Generally, the outer diameter of the drive tube 58' is smaller than the inner diameter of the bore 68' in the main body 46'. However, at the front of the drive tube 58', a bearing member 98 bulges out circumferentially around the front end of the drive tube 58' and slidably engages the bore 68'. By using this configuration, the drive tube 58' is not only capable of sliding linearly through the bore 68', but is also capable of pivoting slightly about the bulging bearing member 98. The camming action of cam 94 along cam follower 96 determines the degree of pivoting in relation to the linear position of the drive tube 58' in the main body 46', and an indication of the preferred distance to the target for the currently adjusted laser beam width is provided on the scale 97.

Operation of the laser unit 4 will now be described with reference to FIGS. 1–5.

Initially, the toggle switch 14 is turned ON and the infrared viewer 12 is activated. As a result, the LED 82 begins to flash and a voltage from the drive power supply appears at the rocker switch 74. Likewise, a voltage from the laser power supply appears at the circuit board 78, which causes the laser 56 to become activated.

Next, if a change in the projection of the infrared beam is desired from a narrow beam to a broader beam (for closer targets for example), the upper part of the rocker switch 74 is depressed away from the neutral position. This causes a positive voltage to be applied to the electric motor 66 and cause rotation of the motor in a first rotational direction (hereinafter referred to as the clockwise direction). Assuming the beam is not already in its broadest state and that the drive tube 58 is therefore not in its most forward position, rotation of the drive shaft causes the follower nut 60 to also rotate. The clutch 62 keeps the follower nut 60 frictionally in engagement with the drive shaft 64 so long as the drive tube 58 has not reached its most forward position.

With the follower nut 60 also rotating in the clockwise direction, the threads on the follower nut 60 impart forward linear movement on the drive tube 58. Since the laser 56 is mounted on the distal end of the drive tube 58, such forward linear movement of the drive tube 58 causes the laser 56 to approach the fixed lens system 54 and hence causes the width of the laser beam to broaden. This widening of the laser beam continues until either the rocker switch 74 is released and allowed to return to its neutral position or the laser beam reaches its widest state.

The point at which the laser beam reaches its widest state is determined by the point at which the drive tube 58 reaches its most forward position. When this occurs, the clutch 62 begins to slip and the drive shaft 64 begins to rotate relative to the follower nut 60. The clutch 62 consequently provides the electric motor 66 with a form of overdrive protection.

If it is desired to change from a broader beam to a narrower beam (for distant targets for example), the lower part of the rocker switch 74 is depressed away from the neutral position. This causes a negative voltage to be applied at the electric motor 66 and hence rotation of the motor in a second rotational direction (hereinafter referred to as the counter-clockwise direction). Assuming the beam is not already in its narrowest state and that the drive tube 58 is therefore not in its most proximal position (near the focal point of the lens system 54), rotation of the drive shaft causes the follower nut 60 to rotate. The clutch 62 again keeps the follower nut 60 frictionally engaged, and therefore rotating with, the drive shaft 64 so long as the drive tube 58 has not reached its most proximal position.

With the follower nut 60 also rotating in the counter-clockwise direction, the threads on the follower nut 60 impart proximal linear movement on the drive tube 58. Since the laser 56 is mounted to the distal end of the drive tube 58, such proximal linear movement of the drive tube 58 also causes the laser 56 to move proximally away from the fixed lens system 54 and hence causes the laser beam to narrow. This narrowing of the laser beam continues until either the rocker switch 74 is released and allowed to return to its neutral position or the laser beam reaches its narrowest state.

The point at which the laser beam reaches its narrowest state is determined by the point at which the drive tube 58 reaches its most proximal position. When this occurs, the clutch 62 again begins to slip and the drive shaft 64 begins to rotate relative to the follower nut 60. The clutch 62 therefore provides the electric motor 66 with a form of overdrive protection in the reverse direction as well.

Preferably, the laser unit 4 operates such that the narrowest beam produces a brilliant dot, while the broadest beam (2 foot diameter Illuminating flood) produces a circular bore sighted laser projection two feet in diameter on a target 75 yards away. Nevertheless, the beam width is adjustable to keep its imprint on the target at a constant diameter size regardless of distance. The effective visible range of the laser unit is at least 1200 yards.

If elevation adjustment becomes necessary, the elevation adjustment bolts 38 can be rotated equally to achieve a greater or lesser pivotal separation between the upper and lower plates 28,30.

Similarly, if windage adjustment becomes necessary, the windage adjustment bolts 52 can be rotated to create a desired degree of yaw between the main body 46 and the barrel 6 of the weapon 2. In particular, the windage adjustment bolt 52 toward which the main body is to be pivoted, is driven away from the slot 32. This allows pivoting of the main body 46 in that same direction. The opposite windage adjustment bolt 52 is then driven further into the slot 32 and into the slide bolt 48, thereby causing pivoting of the main body 46 about the pivot bolt 50. Once the desired degree of yaw is achieved, both windage adjustment bolts 52 are tightened to secure the slide bolt 48 in place.

With reference to FIG. 6, operation of the custom main body 46' will now be described.

The custom main body 46' operates in the same manner as the embodiments of FIGS. 1–5 except that drop compensation is provided for distant targets. The particular amount of drop compensation provided by the custom main body 46' is proportional to target distance and is determined by the camming action between the cam 94 and cam follower 96.

For example, when the beam is broadened by advancing the drive tube 58' forward through the bore 68', the camming action between the cam 94 and cam follower 96 causes the central axis of the laser 56 and longitudinal axis of the drive tube 58' to both move toward alignment with the longitudinal axis of the bore 68' and the central axis of the lens system 54. As a result, there is less drop compensation for a broader beam and correspondingly for closer targets.

On the other hand, when the beam is narrowed (for a more distant target), the drive tube 58' is retracted through the bore 68' away from the lens system 54. As this retraction occurs, the cam follower 96 progressively drops down as a result of the camming action with the cam 94. Since the cam follower 96 is threadably connected to the drive tube 58', the aft portion of the drive tube 58' is likewise forced downwardly, hence producing a pivoting action about the bulging bearing member 98. This pivoting action causes a progressively increasing upward tilt in the longitudinal axis of the drive tube 58' and consequently an upward tilt in the central axis of the laser 56. This upward tilt is illustrated in FIG. 6, which shows the drive tube 58' fully aft (most proximal position) and the longitudinal axis 100 of the drive tube 58' tilted slightly above the longitudinal axis 102 of the bore 68'. Because the lens system 54 performs an inversion, the resulting laser beam is tilted down instead of up. Furthermore, since narrowing of the beam is performed proportionally to target distance, downward drop compensation proportional to target distance is automatically provided.

Figure 7:
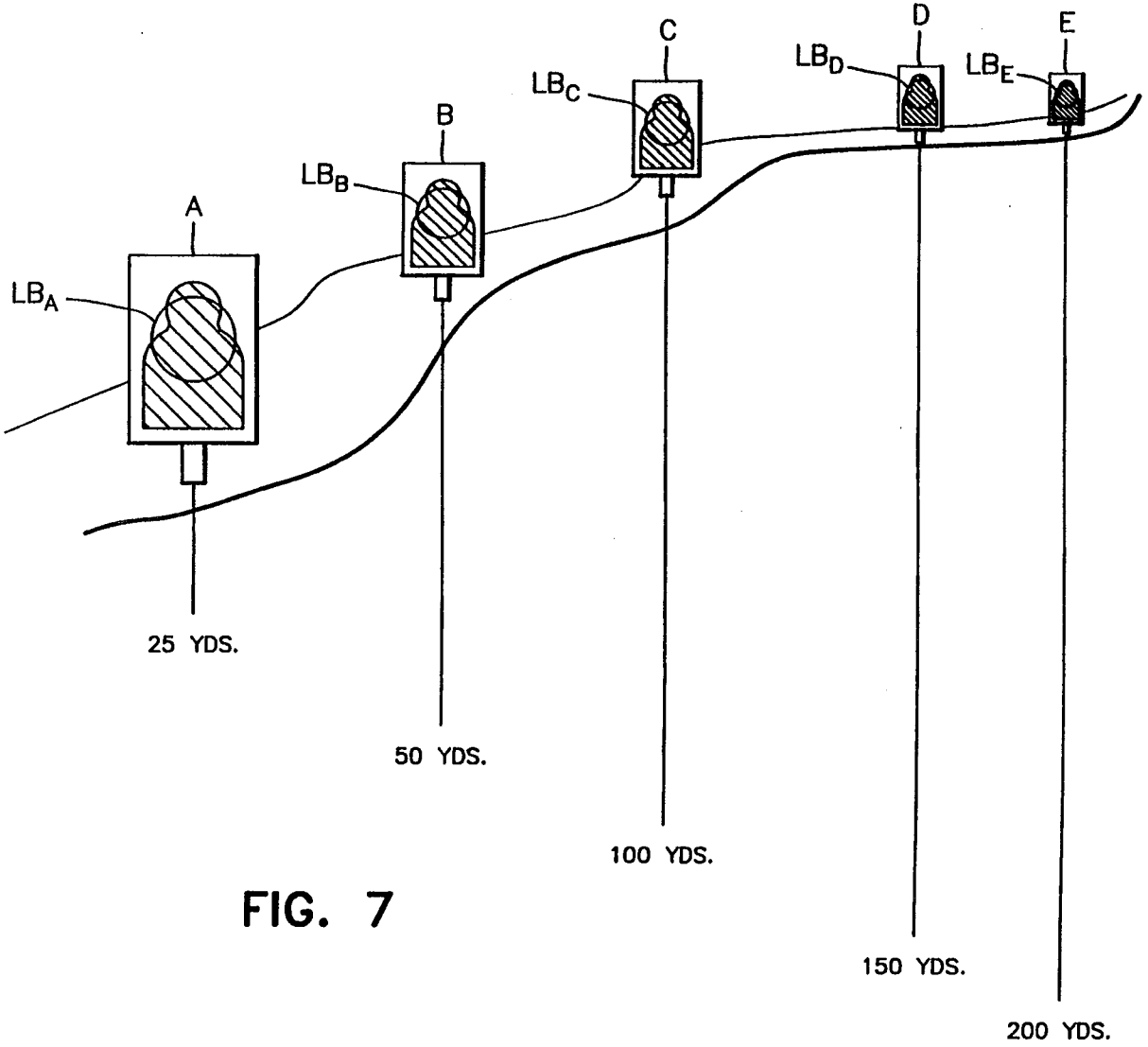
FIG. 7 illustrates some preferred laser beam projections on targets which are disposed at various distances from the laser unit.

With reference to FIG. 7, the distance separating a target from the marksman often varies. Targets A, B, C, D, and E, for example, are twenty-five yards, fifty yards, one-hundred yards, one-hundred and fifty yards, and two-hundred yards away, respectively. With the laser beam sighting apparatus of the present invention, the laser beam emitted from an aiming apparatus may be adjusted to compensate for these different distances, according to the foregoing procedure of operation.

Although the infrared viewer provides a magnification of 2.5× and sufficient brightness for most applications, brighter viewing and more magnification can be provided with other commercially available infrared viewing devices. Likewise, it is understood that the rocker switch connections can be reversed such that depressing the top of the switch causes narrowing of the beam, and depressing the bottom causes broadening. It is further understood that, by rearranging the laser 56 and drive tube 58 beyond the focal point of the lens system 54, forward movement of the drive tube 58 can be used to achieve a narrower beam, while rearward movement is used to achieve broadening.

A further advantageous feature of the sighting apparatus according to the present invention is its ability to automatically compensate for the trajectory of the projectile. At close range targets, such as 25 yards, the beam is automatically aimed slightly higher so that the rifle must be lowered slightly to aim properly at the target and compensate for the rise in the bullet path. Similarly, when aiming at far targets, such as 200 yards or more, the beam is projected lower so that the rifle must be raised to compensate for the fall in the path of the bullet. This automatic beam elevation adjustment is a gradual one.

Furthermore, it is to be understood that the sighting apparatus is amenable to operation with various types of projectiles, from small caliber and large caliber bullets to grenades. Of course, the amount by which these various projectiles rise and fall will differ, and the amount of compensation of the beam will adjust accordingly.

The above description is intended by way of example only and is not intended to limit the present invention in any way except as set forth in the accompanying claims.

I claim:

1. A bore sighted laser beam sighting apparatus for emitting a selectively adjustable laser beam for illuminating a target at various distances from the apparatus, said apparatus comprising:

a main housing having a proximal end and a distal end;

lens means at said distal end of said main housing for projecting a laser beam to a target;

a laser source slidably contained within said main housing, said laser source being slidable linearly through said main housing between said proximal and distal ends;

means for selectively sliding said laser source to substantially any position between said proximal and distal ends of said main body to thereby achieve a particular distance between the laser source and the lens means, said particular distance determining the width of the laser beam.

2. An apparatus according to claim 1, wherein said means for selectively sliding said laser source comprises:

a generally cylindrical drive tube mounted coaxially within said main housing and slidable therein, said laser source being mounted to a distal end of said generally cylindrical drive tube; and means for selectively sliding said generally cylindrical drive tube through said main housing.

3. An apparatus according to claim 1, wherein said means for selectively sliding said laser source comprises:

a generally cylindrical drive tube mounted coaxially within said main housing and slidable therein, said laser source being mounted to a distal end of said generally cylindrical drive tube;

motor means for selectively producing rotary motion; and converting means for converting said rotary motion into linear motion and imparting said linear motion on said generally cylindrical drive tube to selectively move said laser source linearly within said main housing.

4. An apparatus according to claim 1, wherein said means for selectively sliding said laser source includes means for progressively tilting a central axis of said laser source away from a central axis of said apparatus whenever said laser source slides in a direction which tends to narrow said laser beam.

5. The apparatus according to claim 1, wherein the means for sliding also automatically adjusts the elevation of the beam to be slightly higher on close targets and slightly lower on far targets, so as to force the rifle to be aimed slightly lower at close targets and slightly higher at far targets to compensate for the hyperbolic path of a projectile fired by the weapon.

6. An apparatus according to claim 1, and further comprising a remote control means for controlling said means for selectively sliding said laser source.

7. An apparatus according to claim 6, wherein said remote control means comprises a remotely located rocker switch.

8. An apparatus according to claim 1, and further comprising windage and elevation adjusting means for compensating for wind conditions and projectile trajectory.

9. An apparatus according to claim 8, wherein said windage and elevation adjusting means comprises:

upper and bottom plates hingedly attached to one another at a front end, said bottom plate having a slot and a pivot aperture;

at least one elevation adjustment bolt passing through said upper plate and threadably engaging said bottom plate;

a spring circumferentially surrounding an intermediate portion of each elevation adjustment bolt, said spring being arranged so as to apply a separating force which acts to separate the upper plate from the bottom plate;

a slide bolt having an intermediate portion which passes through the slot in the bottom plate, and a distal portion which threadably engages the main housing;

a pivot bolt having an intermediate portion which passes through the pivot aperture, and a distal portion which threadably engages the main housing; and two oppositely disposed windage adjustment bolts disposed through the lateral sides of the bottom plate and in alignment with the slot, the distal tip of each windage adjustment bolt being disposed in the slot so as to engage the intermediate portion of the slide bolt.

10. An apparatus according to claim 1, wherein said means for selectively sliding said laser source comprises:

a generally cylindrical drive tube mounted coaxially within said main housing and slidable therein, said laser source being mounted to a distal end of said generally cylindrical drive tube, said generally cylindrical drive tube having a threaded interior surface;

a follower nut disposed coaxially within said generally cylindrical drive tube and having a substantially smooth interior surface and a threaded outer surface, said threaded outer surface of the follower nut mating with said threaded interior surface of the generally cylindrical drive tube;

a drive shaft passing coaxially through said follower nut, said follower nut being frictionally engaged to said drive shaft;

motor means for producing rotary motion and imparting said rotary motion to said drive shaft, said drive shaft transmitting said rotary motion to said follower nut, and said follower nut converting said rotary motion into thread-induced linear motion of the generally cylindrical drive tube; and means for progressively tilting a central axis of said laser source away from a central axis of said generally cylindrical drive tube whenever said laser source slides in a direction which tends to narrow said laser beam.

11. An apparatus according to claim 10, wherein said means for progressively tilting a central axis of said laser source comprises:

camming means disposed on the main housing, said camming means having a shape which determines the amount of tilt imparted on the central axis of the laser beam in relation to the narrowness of the laser beam;

cam following means disposed through said camming means and cammingly engaged therewith, said cam following means being rigidly attached to said generally cylindrical drive tube;

bearing means bulging circumferentially out from one end of said generally cylindrical drive tube, said bearing means bearing against an inside bore of said main housing and thereby providing a pivot point about which said generally cylindrical drive tube is able to pivot in response to the camming action between the camming means and the cam following means.

12. An apparatus according to claim 1, wherein said means for selectively sliding said laser source comprises:

a generally cylindrical drive tube mounted coaxially within said main housing and slidable therein, said laser source being mounted to a distal end of said generally cylindrical drive tube, said generally cylindrical drive tube having a threaded interior surface;

a follower nut disposed coaxially within said generally cylindrical drive tube and having a substantially smooth interior surface and a threaded outer surface, said threaded outer surface of the follower nut mating with said threaded interior surface of the generally cylindrical drive tube;

a drive shaft passing coaxially through said follower nut, said follower nut being frictionally engaged to said drive shaft; and motor means for producing rotary motion and imparting said rotary motion onto said drive shaft, said drive shaft transmitting said rotary motion to said follower nut, and said follower nut converting said rotary motion into thread-induced linear motion of the generally cylindrical drive tube.

13. An apparatus according to claim 12, and further comprising clutch means mounted circumferentially around said drive shaft between said drive shaft and said follower nut, said clutch means permitting rotation of said drive shaft with respect to said follower nut whenever said motor means continues producing rotary motion after said laser source has reached said proximal or distal ends and said rotary motion would otherwise tend to slide said laser source beyond said proximal or distal ends.

14. An apparatus according to claim 12, and further comprising:

retaining means attached to the end of said drive shaft opposite from said motor means;

a first coil spring disposed circumferentially around said drive shaft, between said retaining means and said follower nut; and a second coil spring disposed circumferentially around said drive shaft, between said follower nut and said motor means.

15. A sighting apparatus for attachment to a weapon, and emitting a selectively adjustable infrared laser beam which illuminates a target at various distances from the weapon, said sighting apparatus comprising:

means for fastening said sighting apparatus to the weapon;

a main housing having a proximal end and a distal end;

lens means at said distal end of said main housing for projecting said laser beam;

a laser source slidably contained within said main housing, said laser source being slidable linearly within said main housing; and means for selectively sliding said laser source to substantially any position to thereby achieve a particular distance between the laser source and the lens means, said particular distance corresponding to a desired width of the laser beam, wherein said means for selectively sliding said laser source comprises:

a generally cylindrical drive tube mounted coaxially within said main housing and slidable therein, said laser source being mounted to a distal end of said generally cylindrical drive tube, said generally cylindrical drive tube having a threaded interior surface;

a follower nut disposed coaxially within said generally cylindrical drive tube and having a substantially smooth interior surface and a threaded outer surface, said threaded outer surface of the follower nut mating with said threaded interior surface of the generally cylindrical drive tube;

a drive shaft passing coaxially through said follower nut, said follower nut being frictionally engaged to said drive shaft; and a reversible D.C. electric motor for producing rotary motion and imparting said rotary motion to said drive shaft, said drive shaft transmitting said rotary motion to said follower nut, and said follower nut converting said rotary motion into thread-induced linear motion of the generally cylindrical drive tube.

16. A sighting apparatus according to claim 15, and further comprising a remote control means mounted on the weapon proximate the trigger hand of a user, for selectively controlling the rotation of said reversible D.C. electric motor.

17. A sighting apparatus according to claim 15, and further comprising windage and elevation adjusting means for manually compensating for wind conditions and projectile trajectory, said windage and elevation adjusting means comprising:

an upper plate rigidly attached to said means for fastening said aiming apparatus to the weapon;

a bottom plate hingedly attached to the upper plate at a front end thereof, said bottom plate having a slot and a pivot aperture;

at least one elevation adjustment bolt passing through said upper plate and threadably engaging said bottom plate;

a spring circumferentially surrounding an intermediate portion of each elevation adjustment bolt, said spring being arranged so as to apply a separating force which acts to separate the upper plate from the bottom plate;

a slide bolt having an intermediate portion which passes through the slot in the bottom plate, and a distal portion which threadably engages the main housing;

a pivot bolt having an intermediate portion which passes through the pivot aperture, and a distal portion which threadably engages the main housing; and two oppositely disposed windage adjustment bolts disposed through the lateral sides of the bottom plate and in alignment with the slot, the distal tip of each windage adjustment bolt being disposed in the slot so as to engage the intermediate portion of the slide bolt.

18. A sighting apparatus according to claim 15, wherein said weapon includes a pistol grip, said pistol grip having a rocker switch disposed thereon for selectively controlling said reversible D.C. electric motor; said aiming apparatus further comprising:

a laser circuit housed within said pistol grip of the weapon;

a laser power supply contained within the weapon, for providing power to the laser source;

a drive power supply housed within the weapon, for providing power to the D.C. electric motor; and a main power switch mounted on the weapon, for selectively breaking the flow of power from the drive power supply and the laser power supply.

19. An aiming apparatus according to claim 15, and further comprising means for progressively tilting a central axis of said laser source away from a central axis of said generally cylindrical drive tube whenever said laser source slides in a direction which tends to narrow said laser beam, said means for progressively tilting a central axis of said laser source comprising:

camming means disposed on the main housing, said camming means having a shape which determines the amount of tilt imparted on the central axis of the laser beam in relation to the narrowness of the laser beam;

cam following means disposed through said camming means and cammingly engaged therewith, said cam following means being rigidly attached to said generally cylindrical drive tube;

bearing means bulging circumferentially out from one end of said generally cylindrical drive tube, said bearing means bearing against an inside bore of said main housing and thereby providing a pivot point about which said generally cylindrical drive tube is able to pivot in response to the camming action between the camming means and the cam following means.

20. A sighting apparatus according to claim 15, and further comprising clutch means mounted circumferentially around said drive shaft between said drive shaft and said follower nut, said clutch means permitting rotation of said drive shaft with respect to said follower nut in response to said motor continuing to produce rotary motion after said laser source has reached either said proximal or distal end of the main body and said continued rotary motion would otherwise tend to slide said laser source beyond said proximal or distal end.

21. A sighting apparatus according to claim 20, and further comprising:

retaining means attached to the end of said drive shaft opposite from said motor means;

a first coil spring disposed circumferentially around said drive shaft, between said retaining means and said follower nut; and a second coil spring disposed circumferentially around said drive shaft, between said follower nut and said motor.

22. A laser beam sighting apparatus for attachment to a host projectile launching weapon and for emitting a selectively adjustable laser beam for illuminating a target at various distances from the apparatus, said apparatus comprising:

a main housing having a proximal end and a distal end;

means for attaching said main housing to said host projectile launching weapon;

lens means at said distal end of said main housing for projecting a laser beam to a target;

a laser source slidably contained within said main housing, said laser source being slidable linearly through said main housing between said proximal and distal ends;

means for selectively sliding said laser source to substantially any position between said proximal and distal ends of said main body to thereby achieve a particular distance between the laser source and the lens means, said particular distance determining the width of the laser beam; and means for compensating for a trajectory arc of a projectile to be launched by a host weapon.

23. The apparatus according to claim 22, wherein said means for selectively sliding said laser source comprises:

a generally cylindrical drive tube mounted coaxially within said main housing and slidable therein, said laser source being mounted to a distal end of said generally cylindrical drive tube, said generally cylindrical drive tube having a threaded interior surface;

a follower nut disposed coaxially within said generally cylindrical drive tube and having a substantially smooth interior surface and a threaded outer surface, said threaded outer surface of the follower nut mating with said threaded interior surface of the generally cylindrical drive tube;

a drive shaft passing coaxially through said follower nut, said follower nut being frictionally engaged to said drive shaft;

motor means for producing rotary motion and imparting said rotary motion to said drive shaft, said drive shaft transmitting said rotary motion to said follower nut, and said follower nut converting said rotary motion into thread-induced linear motion of the generally cylindrical drive tube; and said means for compensating comprising means for progressively tilting a central axis of said laser source away from a central axis of said generally cylindrical drive tube whenever said laser source slides in a direction which tends to narrow said laser beam.

24. An apparatus according to claim 23, wherein said means for progressively tilting a central axis of said laser source comprises:

camming means disposed on the main housing, said camming means having a shape which determines the amount of tilt imparted on the central axis of the laser beam in relation to the narrowness of the laser beam;

cam following means disposed through said camming means and cammingly engaged therewith, said cam following means being rigidly attached to said generally cylindrical drive tube;

bearing means bulging circumferentially out from one end of said generally cylindrical drive tube, said bearing means bearing against an inside bore of said main housing and thereby providing a pivot point about which said generally cylindrical drive tube is able to pivot in response to the camming action between the camming means and the cam following means.

* * * * *